US011724369B2

(12) United States Patent
Karacostas

(10) Patent No.: US 11,724,369 B2
(45) Date of Patent: Aug. 15, 2023

(54) TORQUE WRENCH ADAPTER

(71) Applicant: Robert Bosch GmbH, Stuttgart (DE)

(72) Inventor: Steven Karacostas, Plano, TX (US)

(73) Assignees: Bosch Antomotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 107 days.

(21) Appl. No.: 16/722,256

(22) Filed: Dec. 20, 2019

(65) Prior Publication Data

US 2021/0187709 A1 Jun. 24, 2021

(51) Int. Cl.
*B25B 23/00* (2006.01)

(52) U.S. Cl.
CPC ..... *B25B 23/0035* (2013.01); *B25B 23/0007* (2013.01); *B25B 23/0021* (2013.01); *B25B 23/0028* (2013.01)

(58) Field of Classification Search
CPC ..... B25B 23/0035; B25B 23/0007; B25B 23/0021; B25B 23/0028; B25B 13/48
USPC ..... 81/180.1, 11, 185; 33/433
See application file for complete search history.

(56) References Cited

U.S. PATENT DOCUMENTS 4,416,173 A 11/1983 Rebish
5,860,338 A 1/1999 Littlefield
5,931,063 A * 8/1999 Kuo ..... B25B 23/0035 81/119
6,234,051 B1 * 5/2001 Bareggi ..... B25B 23/0035 81/479
6,748,828 B2 6/2004 Bollinger
8,261,638 B2 * 9/2012 Hsu ..... B25B 13/06 81/124.4
2020/0061779 A1 * 2/2020 Gunther ..... B25G 1/005

OTHER PUBLICATIONS

"Hazet 6423D"—https://www hazet.de/en/products/torque-technology/insert-tool/2027/insert-adapter?number-en_6423D.
"Hazet 6423C"—https://www hazet.de/en/products/torque-technology/insert-tool/2027/insert-adapter?number-en_6423C.

(Continued)

*Primary Examiner* — Don M Anderson
*Assistant Examiner* — Caleb Andrew Holizna
(74) *Attorney, Agent, or Firm* — Kathy Takeguchi

(57) ABSTRACT

A tool adapter includes a body, which is elongated along a first axis. The body includes at least a first side surface that is opposite to the second side surface, as well as a first end surface that is opposite to the second end surface. The body includes a first input drive connector, which is located at a middle section of the body and which is accessible from the first side surface. The first input drive connector is structured to mate with a first drive part of a torque wrench such that a longitudinal axis of the torque wrench is parallel to the first axis when the torque wrench is connected to the adapter. The body includes a first output drive connector that is located at a middle region of the first end surface. The first output drive connector is structured to mate with a first connector part of a tool head such that a longitudinal axis of the tool head is parallel to the first axis when the tool head is connected to the adapter. The first input drive connector is defined to be a first size. The first output drive connector is defined to be a second size, which is different from the second size.

20 Claims, 7 Drawing Sheets

(56) References Cited

OTHER PUBLICATIONS

"Hazet 6401-1"—https://www.hazet.de/en/products/torque-technology/insert-tool/2023/insert-reversible-ratchet-640-1-1-with-insert-square?number=en_6401-1.
"Hazet 6292-1 CT"—https://www.hazet.de/en/products/torque-technology/mechanical/16868/torque-wrench-6200-1-ct-2-500-nmwith-insert-square-tolerance-2/4?number=en_6292-1CT.
"Hazet 6290-1CT/29" - https://www.hazet.de/en/products/torque-technology/mechanical/16868/torque-wrench-6200-1-ct-2-500-nm-with-insert-square-tolerance-2-4/?number=en_6290-1CT-SLASH-29.

* cited by examiner

TORQUE WRENCH ADAPTER

FIELD

This disclosure relates generally to tools, and more particularly to adapters.

BACKGROUND

In general, there are some wrench components that are configured with European sized dimensions, which are incompatible with other wrench components that are configured with American sized dimensions. The incompatibility between these wrench components can be problematic in various scenarios, such as when global contracts necessitate that specific tools are imported to other regions due to standard sizing issues and/or original equipment (OE) preference. The importing of specific wrench components for this purpose is costly, especially when technicians possess similar tools, but are unable to use them due to the mere differences in standard sizes and/or regional conventions.

SUMMARY

The following is a summary of certain embodiments described in detail below. The described aspects are presented merely to provide the reader with a brief summary of these certain embodiments and the description of these aspects is not intended to limit the scope of this disclosure. Indeed, this disclosure may encompass a variety of aspects that may not be explicitly set forth below.

According to at least one aspect, an adapter includes a body that is elongated along a first axis. The body includes a first side surface, a second side surface, a first end surface, and a second end surface. The first side surface is opposite to the second side surface. The first end surface is opposite to the second end surface. The body includes a first input drive connector, which is located at a middle section of the body and which is accessible from the first side surface. The first input drive connector is structured to mate with a first drive part of a first torque wrench such that a longitudinal axis of the first torque wrench is parallel to the first axis when the first torque wrench is connected to the adapter. The body includes a first output drive connector, which is located at a middle region of the first end surface. The first output drive connector is structured to mate with a first connector part of a first tool head such that a longitudinal axis of the first tool head is parallel to the first axis when the first tool head is connected to the adapter. The first input drive connector is defined to be a first size. The first output drive connector is defined to be a second size. The first size is different than the second size.

According to at least one aspect, an adapter includes at least a body and a first extension portion. The body is elongated along a first axis. The body has a middle section, which is between a first end section and a second end section, when taken along the first axis. A first extension portion is located at a middle section of the body. The first extension portion extends outward from a first side surface of the body along a second axis. The first extension portion includes a first input drive connector to receive a first drive part of a first torque wrench such that a longitudinal axis of the first torque wrench is parallel to the first axis when the first torque wrench is connected to the adapter. The first drive part is a first size. The first end section includes a first output drive connector to receive a first connector part of a first tool head such that a longitudinal axis of the first tool head is parallel to the first axis when the first tool head is connected to the adapter. The first connector part is a second size. The first size is different from the second size. The first axis is perpendicular to the second axis.

According to at least one aspect, a tool assembly includes a torque wrench, a tool head, and an adapter. The torque wrench has a drive part of a first size. The tool head has a connector part of a second size. The adapter is configured to connect to and disconnect from the torque wrench. The adapter is configured to connect to and disconnect from the tool head. The adapter includes a body. The body is elongated along a first axis. The body includes a first side surface, a second side surface, a first end surface, and a second end surface. The first side surface is opposite to the second side surface. The first end surface is opposite to the second end surface. The body includes a first input drive connector, which is located at a middle section of the body and which is accessible from the first side surface. The first input drive connector is structured to mate with the drive part of the torque wrench such that a longitudinal axis of the torque wrench is parallel to the first axis when the torque wrench is connected to the adapter. The body includes a first output drive connector, which is located at a middle region of the first end surface. The first output drive connector is structured to mate with the connector part of the tool head such that a longitudinal axis of the tool head is parallel to the first axis when the tool head is connected to the adapter. The first size is different than the second size.

These and other features, aspects, and advantages of the present invention are discussed in the following detailed description in accordance with the accompanying drawings throughout which like characters represent similar or like parts.

DETAILED DESCRIPTION

Figure 1A:
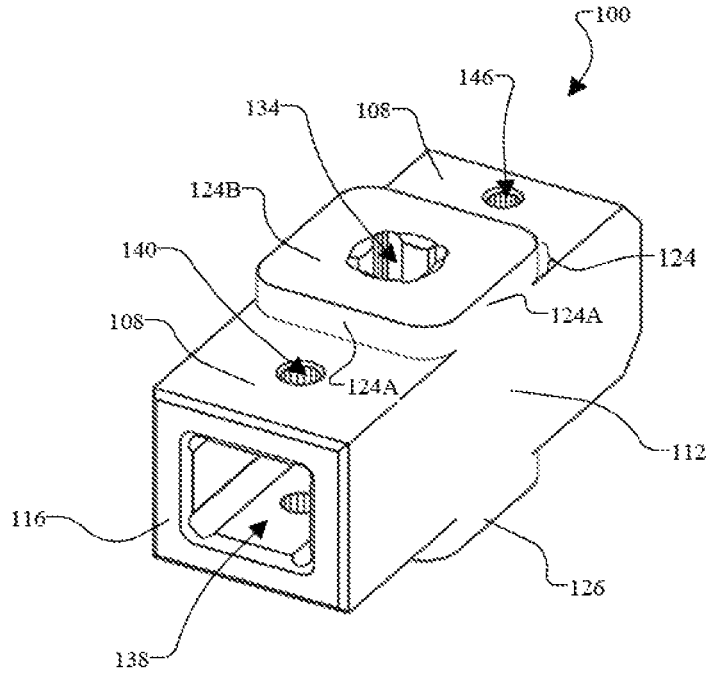
FIG. 1A is a perspective view of an adapter in which its first side is visible according to an example embodiment of this disclosure.

The embodiments described herein, which have been shown and described by way of example, and many of their advantages will be understood by the foregoing description, and it will be apparent that various changes can be made in the form, construction, and arrangement of the components without departing from the disclosed subject matter or without sacrificing one or more of its advantages. Indeed, the described forms of these embodiments are merely explanatory. These embodiments are susceptible to various modifications and alternative forms, and the following claims are intended to encompass and include such changes and not be limited to the particular forms disclosed, but rather to cover all modifications, equivalents, and alternatives falling with the spirit and scope of this disclosure.

FIGS. 1A-1B, 2A-2B, 3A-3B, 4A-4B, and 5A-5B illustrate various views of the adapter 100 according to an example embodiment. The adapter 100 is structured to provide a secure connection between a selected one of various sized torque wrenches and a selected one of various sized tool heads (and/or wrench adapters) such that the selected torque wrench is usable with the selected tool head. The adapter 100 is configured to connect to and disconnect from the various sized torque wrenches with various sized drive parts. In addition, the adapter 100 is configured to connect to and disconnect from the various sized tool heads with various sized connector parts. For instance, the tool head may include an insert open-end wrench, an insert closed-end wrench, or any suitable mechanical device.

In an example embodiment, the adapter 100 comprises a composition that provides sufficient strength and rigidity for the adapter 100 to provide a secure connection between a selected torque wrench and a selected tool head while withstanding various forces and torques associated with its use. In an example embodiment, for instance, the adapter 100 comprises hardened steel. In another embodiment, the adapter 100 comprises any suitable metal, alloy, or material, which is configured to connect a selected torque wrench to a selected tool head to create a tool assembly that is configured to transfer torque to an object, such as a mechanical fastener or any suitable physical device.

In an example embodiment, the adapter 100 is a monolithic, unitary structure of a single composition. This feature is advantageous as this enables the adapter 100 to be easy to fabricate. This feature is also advantageous in providing the adapter 100 with strength and rigidity compared to having one or more connection points. However, the adapter 100 is not limited to this construction, but may comprise a plurality of parts, which are securely connected (e.g., welded, fastened, etc.) together to form a single structural unit.

The adapter 100 is a structure that is elongated along a longitudinal axis 10 and is also symmetrical about its longitudinal axis 10. More specifically, the adapter includes at least a body 102, which is elongated along the longitudinal axis 10. For example, in FIG. 3A, the body 102 includes a first portion 104 and a second portion 106. In this example, the first portion 104 is a prism portion while the second portion 106 is a tapered portion. The prism portion comprises any suitable shape that is structured to provide the functionality described herein. For example, in FIGS. 1A-1B and 2A-2B, the prism portion is rectangular with four lateral sides and two base sides. The lateral sides include a first side, a second side, a third side, and a fourth side. The first side is opposite to the second side. The third side is opposite to the fourth side. The first side includes a first side surface 108, the second side includes a second side surface 110, the third side includes a third side surface 112, and the fourth side includes a fourth side surface 114. The first side surface 108 and the second side surface 110 face in opposite directions. The third side surface 112 and the fourth side surface 114 face in opposite directions. Also, the first base side includes a first end surface 116 and the second base side includes a second end surface 118. The first end surface 116 and the second end surface 118 face in opposite directions. Alternatively to this rectangular construct with straight edges, the body 102 may comprise a geometric shape with one or more curved portions provided that the body 102 provides the functionality as described herein.

Figure 3A:
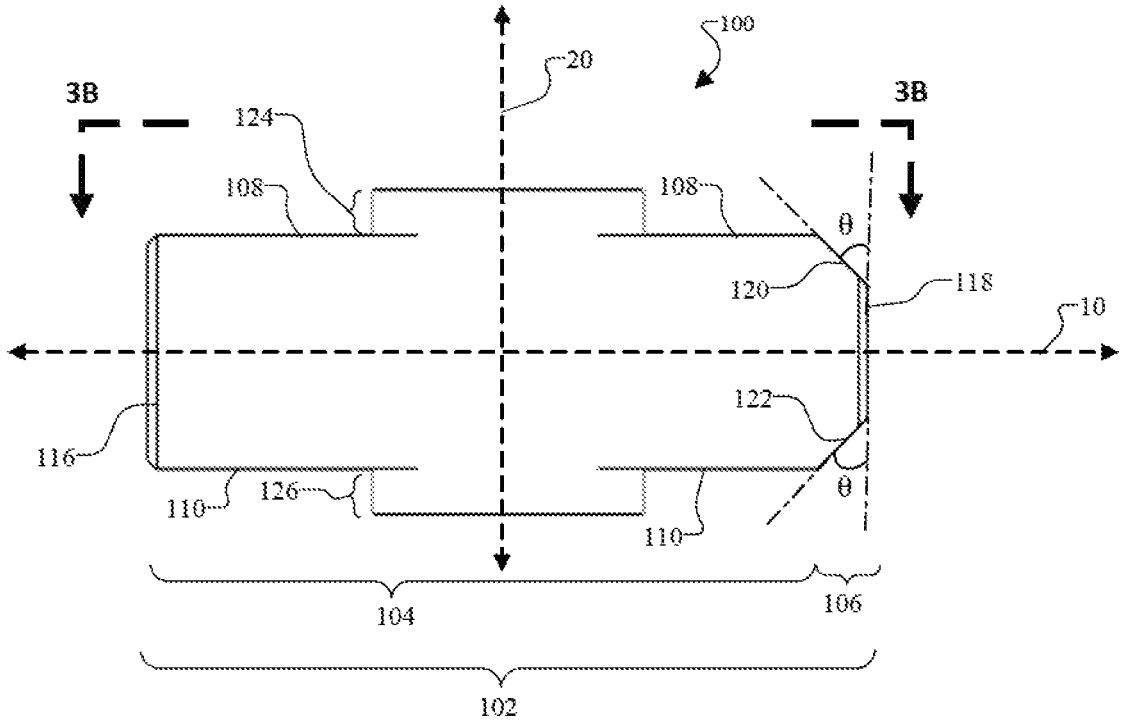
FIG. 3A is a side view of the adapter according to an example embodiment of this disclosure.

The second portion 106 is tapered from an end of the first portion 104 to the second end surface 118 such that a cross section at the prism portion of the body 102 is larger than a cross section at the end portion of the body 102. In this regard, the body 102 has its smallest cross-section at the second end surface 118. More specifically, as shown in FIG. 3A, for instance, the tapered portion is defined by two inclined surfaces. The first inclined surface 120 adjoins and transitions the first side surface 108 to the second end surface 118. The second inclined surface 122 adjoins and transitions the second side surface 110 to the second end surface 118. These inclined surfaces are positioned at opposite sides of the body 102. The inclined surfaces also face in opposite directions. Also, as shown in FIG. 3A, each inclined surface is at an angle 9, which is a 45 degree angle (or any suitable angle between 0 and 90 degrees) with respect to the adjacent second end surface 118 in accordance with specified tolerances of manufacture. Alternatively, the inclined surfaces may be at any customized angle to provide sufficient clearance based on the configuration of the desired tool head and the desired application. In this regard, the tapered portion is advantageous in providing clearance to the tool head during use or operation such that edges of the adapter 100 do not interfere with a work piece that includes the object that is to be applied with torque. Alternatively, the body 102 may comprise the prism portion along its full length without the tapered portion such that the first end surface 116 is the same size as the second end surface 118 if no clearance is deemed necessary.

The adapter 100 also includes extension portions, which protrude outward from the body 102 along a lateral axis 20 ("second axis"), which is perpendicular to the longitudinal axis 10. The extension portions include a first extension portion 124 and a second extension portion 126, which are located at a middle section or center section 128 of the body 102. The center section 128 is provided between a first end section 130 and a second end section 132 of the body 102. More specifically, the first extension portion 124 extends outward from a first side surface 108 of the body 102 while the second extension portion 126 extends outward from a second side surface 110 of the body 102. The first extension portion 124 is aligned with the second extension portion 126 about a center and/or center section 128 of the body 102. The first extension portion 124 is symmetrical about the second axis 20. The second extension portion 126 is symmetrical about the second axis 20.

Figure 1B:
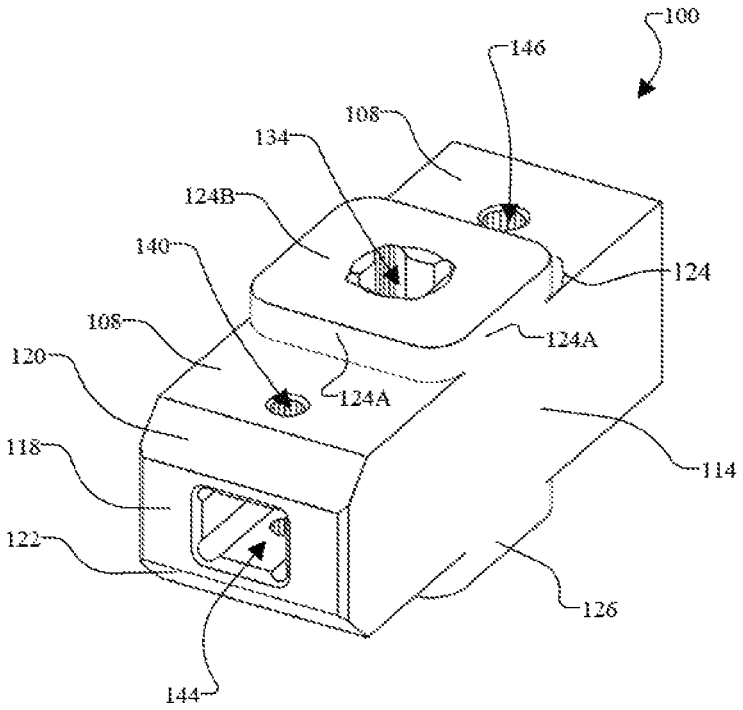
FIG. 1B is another perspective view of the adapter in which its first side is visible according to an example embodiment of this disclosure.
Figure 4A:
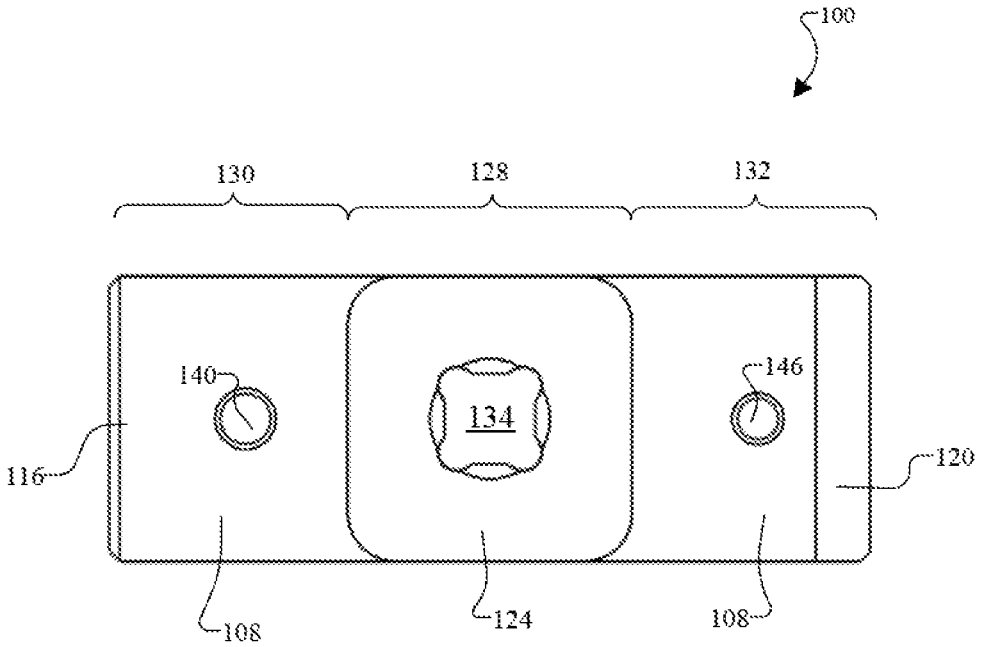
FIG. 4A is a view of a first side of the adapter according to an example embodiment of this disclosure.

The first extension portion 124 comprises a generally rectangular shape with walls 124A that are parallel to the side surfaces 108-112 of the body 102. As shown in FIG. 4A, the first extension portion 124 may include some curvature, such as at the corner portions. Also, as shown in FIGS. 1A and 1B, the first extension portion 124 has two walls 124A that are flush with the third side surface 112 and the fourth side surface 114, respectively. In addition, the first extension portion 124 has two walls 124A that are inward and spaced from the first end surface 116 and the second end surface 118, respectively.

Figure 2A:
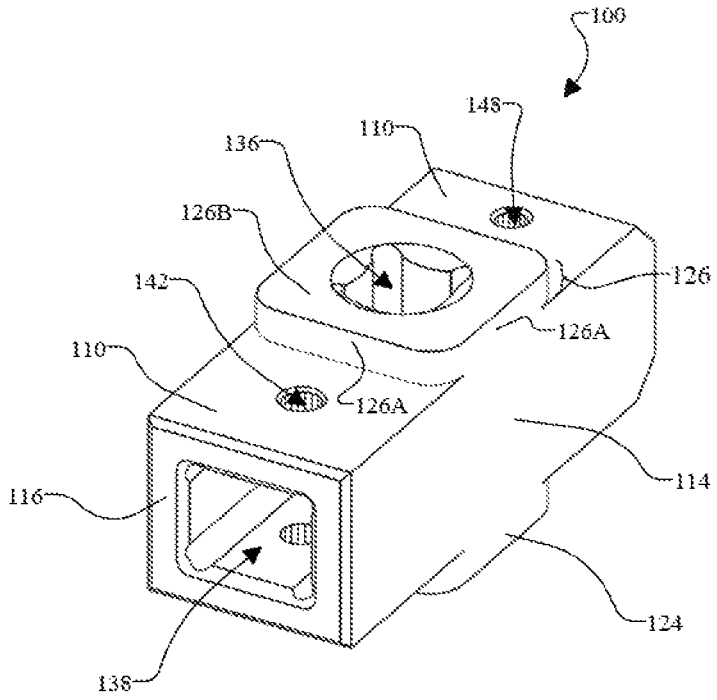
FIG. 2A is a perspective view of the adapter in which its second side is visible according to an example embodiment of this disclosure.
Figure 2B:
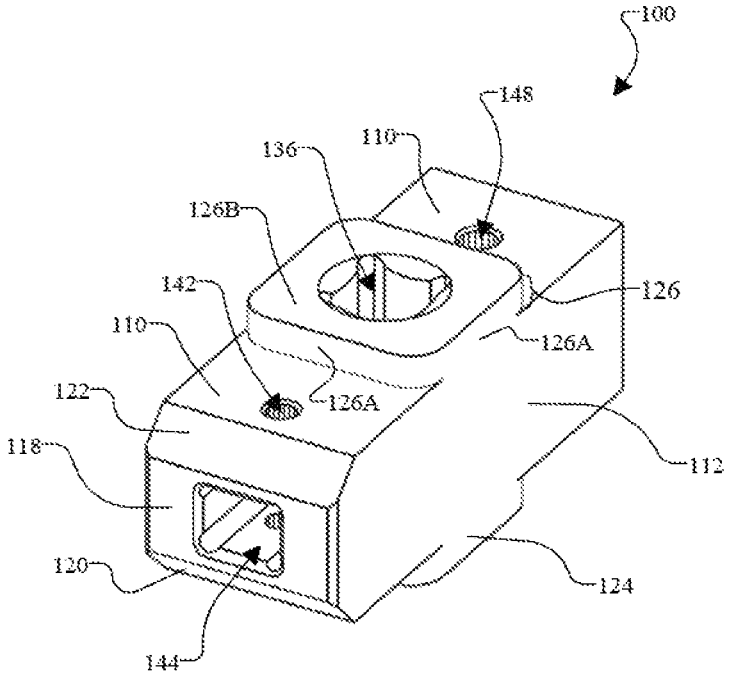
FIG. 2B is another perspective view of the adapter in which its second side is visible according to an example embodiment of this disclosure.
Figure 4B:
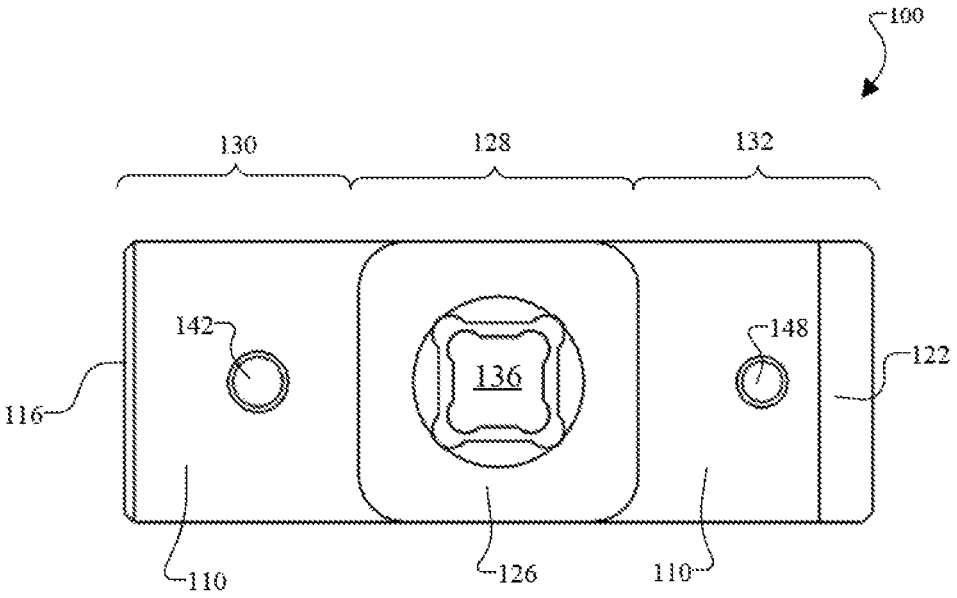
FIG. 4B is a view of a second side the adapter according to an example embodiment of this disclosure.

The second extension portion 126 comprises a generally rectangular shape with walls 126A that are parallel to the side surfaces 108-112 of the body 102. As shown in FIG. 4B, the second extension portion 126 may include some curvature, such as at the corner portions. Also, as shown in FIGS. 2A and 2B, the second extension portion 126 has two walls 126A that are flush with the third side surface 112 and the fourth side surface 114, respectively. In addition, the second extension portion 126 has walls 126A that are inward and spaced from the first end surface 116 and the second end surface 118, respectively.

Figure 3B:
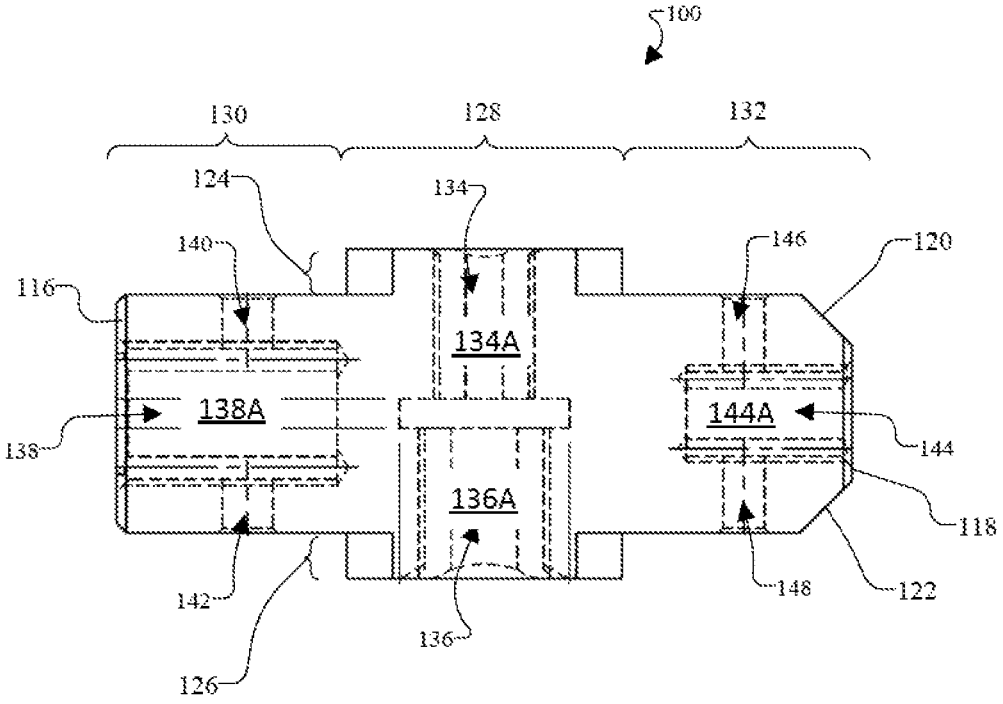
FIG. 3B is a view of a cross-section, taken at line 3B-3B of the adapter of FIG. 3A, according to an example embodiment of this disclosure.

The first extension portion 124 includes a first input drive connector 134. The first input drive connector 134 is located at a center and/or center region of the first extension portion 124. The first input drive connector 134 is accessible from the first side via the surface 124B on the first side surface 108. The first extension portion 124, via the first input drive connector 134, is configured to connect to and disconnect from a drive part on a head portion of the torque wrench. More specifically, as shown in FIG. 3B, the first extension portion 124 has inner walls 134A, which define the first input drive connector 134 with a socket of a predetermined size and which is structured to receive a corresponding drive part of the predetermined size. The inner walls 134A extend along the second axis 20 from the surface 124B towards a central area of the body 102. In FIG. 4A, the inner walls 134A define a socket having a cross-sectional shape that is rectangular or substantially rectangular with fillets. More specifically, in FIG. 4A, the first input drive connector 134 is a standard ⅜ inch female square drive opening.

The second extension portion 126 includes a second input drive connector 136. The second input drive connector 136 is located at a center and/or center region of the second extension portion 126. The second input drive connector 136 is accessible from the second side via the surface 126B on the second side surface 110. The second extension portion 126, via the second input drive connector 136, is configured to connect to and disconnect from another drive part on a head portion of the torque wrench. More specifically, as shown in FIG. 3B, the second extension portion 126 has inner walls 136A, which define the second input drive connector 136 with a socket of another predetermined size and which is structured to receive a corresponding drive part of that another predetermined size. The inner walls 136A extend along the second axis 20 from the surface 126B towards the central area of the body 102. In FIG. 4B, the inner walls 136A define a socket having a cross-sectional shape that is rectangular or substantially rectangular with fillets. More specifically, in FIG. 4B, for instance, the second input drive connector 136 is a standard ½ inch female square drive opening.

In an example embodiment, the first input drive connector 134 is aligned with the second input drive connector 136. That is, the first input drive connector 134 is coaxial with the second input drive connector 136. Also, the first input drive connector 134 and the second input drive connector 136 are centered about the adapter 100. For example, in FIG. 3B, the first input drive connector 134 and the second input drive connector 136 are aligned and create a through-hole that passes through the center section 128 of the body 102 from the surface 124B to the surface 126B. In an alternative embodiment, the body 102 may include a portion that provides a physical barrier (not shown) to separate a space of the first input drive connector 134 and the second input drive connector 136.

Figure 5A:
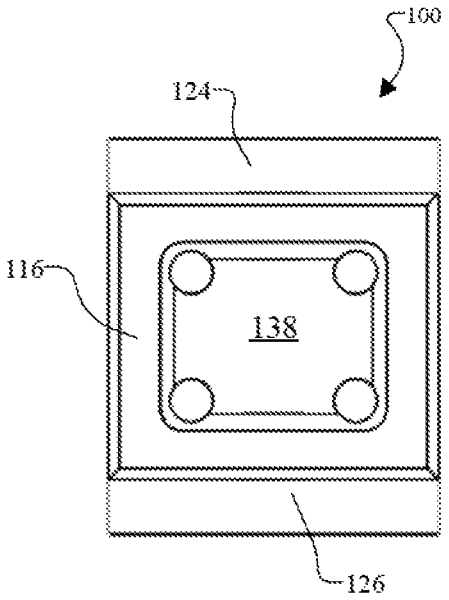
FIG. 5A is a view of a first base side of the adapter of FIG. 1 according to an example embodiment of this disclosure.

The first end section 130 includes a first output drive connector 138. The first output drive connector 138 is accessible from the first base side at the first end surface 116. The inner walls 138A of the body 102, which define a socket, extend along the longitudinal axis 10. The first output drive connector 138 is located at a middle region or center region of the first end surface 116. The first end section 130, via the first output drive connector 138, is configured to connect to and disconnect from a corresponding connector part on a tool head. More specifically, the inner walls 138A, which define the first output drive connector 138, are structurally defined to receive a connector part that is a specified size. The inner walls 138A extend along the first axis 10 from the first end surface 116 towards the center section 128 of the body 102. In FIG. 5A, the inner walls 138A define a socket having a cross-sectional shape that is rectangular or substantially rectangular with fillets. More specifically, in FIG. 5A, for instance, the first output drive connector 138 is a 14 mm×18 mm female rectangular drive opening.

In addition, the first end section 130 includes an attachment mechanism 140 on the first side surface 108 and an attachment mechanism 142 on the second side surface 110. In this regard, the attachment mechanism 140 overlaps the first output drive connector 138. The attachment mechanism 142 overlaps the first output drive connector 138. More specifically, the attachment mechanism 140 and the attachment mechanism 142 are aligned and communicatively connected to the first output drive connector 138 such that a tool head is enabled to connect to the first output drive connector 138 and attach to a corresponding attachment mechanism 140/142, for instance, by a snap fit. More specifically, FIG. 4A illustrates the attachment mechanism 140, which is located on the first side surface 108 between the first extension portion 124 and the first end surface 116. The attachment mechanism 140 is structured to attach to and detach from an attachment device 210 (FIG. 6), such as a detent, on a selected tool head 206, when that selected tool head 206 is connected to the first output drive connector 138 and when a selected torque wrench 202 is connected to the second input drive connector 136. Meanwhile, FIG. 4B illustrates the attachment mechanism 142, which is located on the second side surface 110 between the second extension portion 126 and the first end surface 116. The attachment mechanism 142 is structured to attach to and detach from an attachment device 210, such as detent, on a selected tool head 206 when that selected tool head 206 is connected to the first output drive connector 138 and when a selected torque wrench is connected to the first input drive connector 134. As a non-limiting example, for instance, the attachment mechanism 140/142 is a through-hole and the attachment device 210 is a detent (e.g., protrusion), which is structured to mate with the through-hole. However, the adapter 100 is not limited to this attachment mechanism 140/142, but may include any suitable mechanical structure that is enabled to attach and detach from the tool head 206 while enhancing the connection between the connector part 208 of the tool head 206 and the first output drive connector 138.

The second end section 132 includes a second output drive connector 144. The second output drive connector 144 is accessible from the second base side at the second end surface 118. The inner walls 144A of the body 102, which define a socket, extend from the second end surface 118 and toward a center section 128 along the longitudinal axis 10.

Figure 5B:
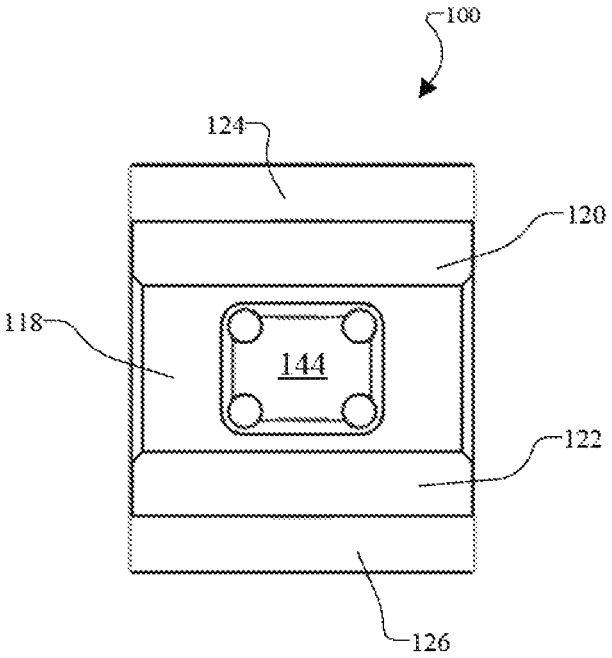
FIG. 5B is a view of a second base side of the adapter of FIG. 1 according to an example embodiment of this disclosure.

The second output drive connector 144 is located at a middle region or center region of the second end surface 118. The second end section 132, via the second output drive connector 144, is configured to connect to and disconnect from a corresponding connector part on a tool head. More specifically, the inner walls 144A, which define the second output drive connector 144, are structurally defined to receive a part that another specified size. The inner walls 144A extend along the first axis 10 from the second end surface 118 towards the center section 128 of the body 102. In FIG. 5B, the inner walls 144A define a socket having a cross-sectional shape that is rectangular or substantially rectangular with fillets. More specifically, in FIG. 5B, for instance, the second output drive connector 144 is a 9 mm×12 mm female rectangular drive opening.

In addition, the second end section 132 includes an attachment mechanism 146 on the first side surface 108 and an attachment mechanism 148 on the second side surface 110. In this regard, the attachment mechanism 146 overlaps the second output drive connector 144. The attachment mechanism 148 overlaps the second output drive connector 144. More specifically, the attachment mechanism 146 and the attachment mechanism 148 are aligned and communicatively connected to the second output drive connector 144 such that a tool head is enabled to connect to the second output drive connector 144 and attach to a corresponding attachment mechanism 146/148, for instance, by a snap fit. More specifically, FIG. 4A illustrates the attachment mechanism 146, which is located on the first side surface 108 between the first extension portion 124 and the second end surface 118. The attachment mechanism 146 is structured to attach to and detach from an attachment device 210 on a selected tool head 206 when that selected tool head 206 is connected to the second output drive connector 144 and when a selected torque wrench is connected to the second input drive connector 136. Meanwhile, FIG. 4B illustrates the attachment mechanism 148, which is located on the second side surface 110 between the second extension portion 126 and the second end surface 118. The attachment mechanism 148 is structured to attach to and detach from an attachment device 210 on a selected tool head 206 when that selected tool head 206 is connected to the second output drive connector 144 and when a selected torque wrench 206 is connected to the first input drive connector 134. As a non-limiting example, for instance, the attachment mechanism 146/148 is a through-hole and the attachment device 210 is a protrusion, which is structured to mate with the through-hole. However, the adapter 100 is not limited to this attachment mechanism 146/148, but may include any suitable mechanical structure that is enabled to attach to and detach from the tool head 206 while enhancing the connection between the connector part 208 of the tool head 206 and the second output drive connector 144.

In an example embodiment, the first output drive connector 138 is aligned with the second output drive connector 144. That is, the first output drive connector 138 is coaxial with the second output drive connector 144. Also, the first output drive connector 138 and the second output drive connector 144 are centered about the first axis 10 of the adapter 100. In FIG. 3B, the body 102 includes a portion that provides a physical barrier, which physically separates the first output drive connector 138 from the second output drive connector 144. In an alternative embodiment, the first output drive connector 138 and the second output drive connector 144 are aligned and create a through-hole from the first end surface 116 to the second end surface 118.

Figure 6A:
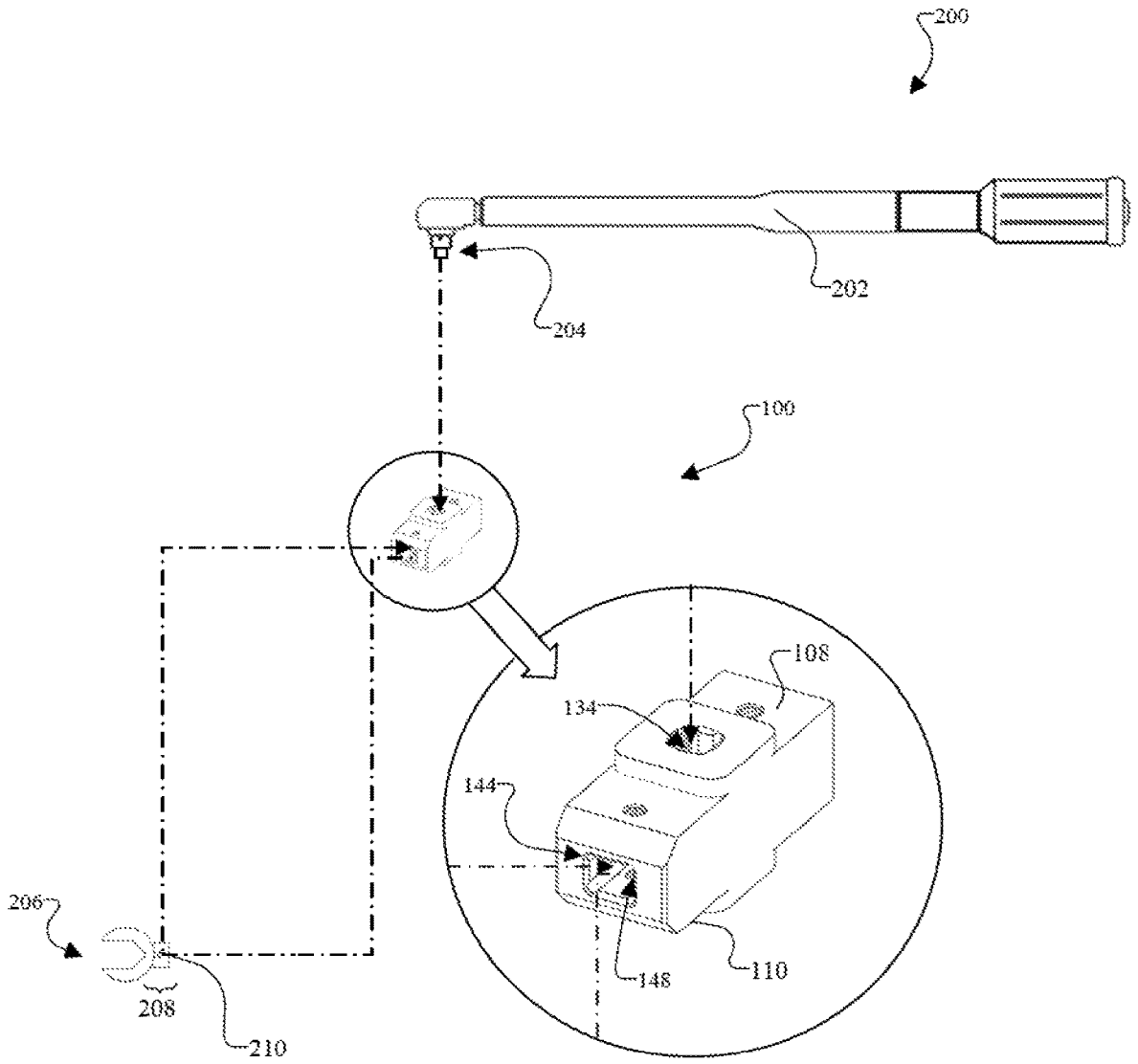
FIG. 6A is an exploded view of an example of a tool assembly with the adapter according to an example embodiment of this disclosure.
Figure 6B:
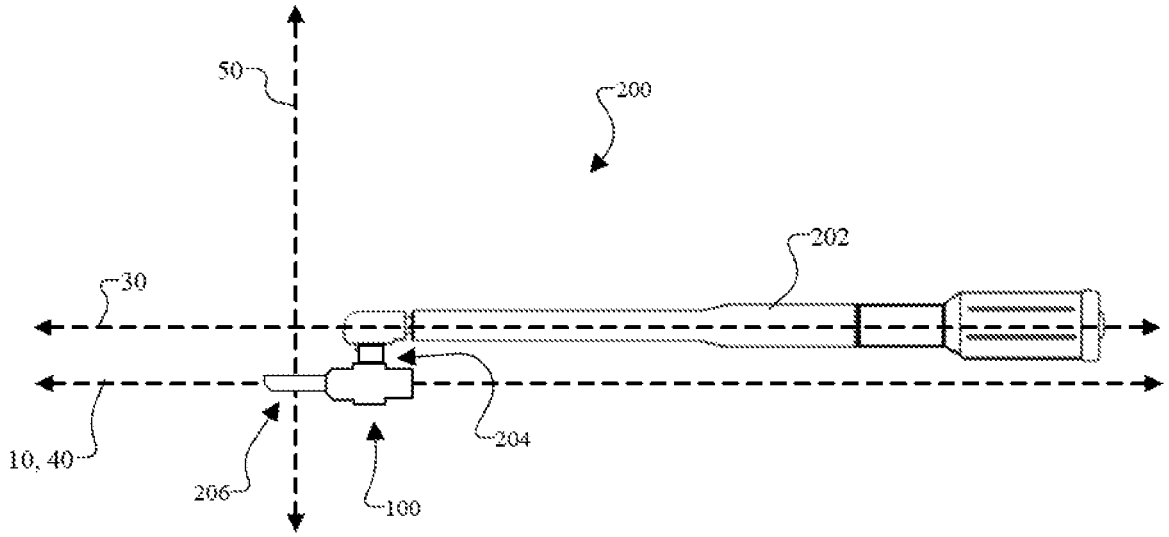
FIG. 6B is a side view of the tool assembly of FIG. 6A according to an example embodiment of this disclosure.
Figure 6C:
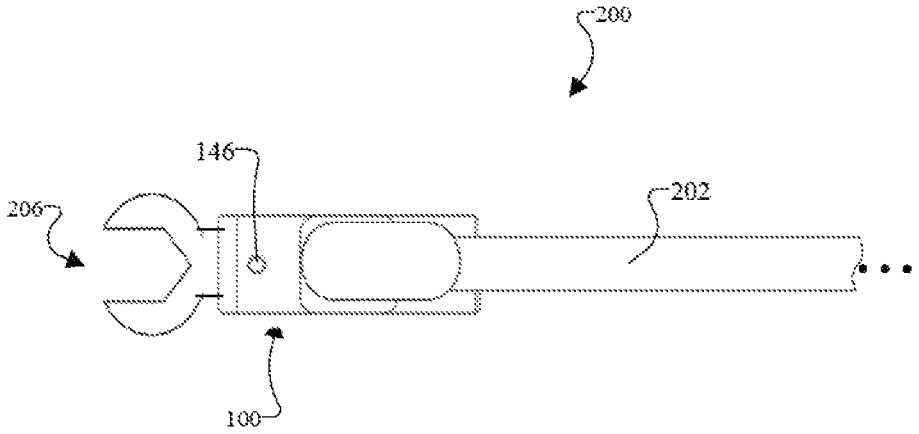
FIG. 6C is a top view of the tool assembly of FIG. 6A according to an example embodiment of this disclosure.

FIGS. 6A, 6B, and 6C illustrate various views of an example of a tool assembly 200 according to an example embodiment. FIGS. 6A, 6B, and 6C are not drawn to scale, but are provided for the conceptual information that they convey. More specifically, this tool assembly 200, via the adapter 100, includes a connection between (i) a torque wrench 202 with a drive part 204 that mates with the first input drive connector 134 and (ii) a tool head 206 with a connector part 208 that mates with the second output drive connector 144. In addition, as shown in FIG. 6A, the tool head 206 includes an attachment device 210, which is structured to mate with the corresponding attachment mechanism 148 (e.g., detent) on the second side surface 110 such that the attachment mechanism 148 projects outward in a same direction (e.g., downward direction) as the drive part 204. Also, as shown in FIGS. 6B-6C, when connected, the longitudinal axis 10 of the adapter 100 is parallel to the longitudinal axis 30 of the torque wrench 202 and the longitudinal axis 40 of the tool head 206. This tool assembly 200 is advantageous in being enabled to apply a smaller torque to a smaller object, such as a mechanical fastener, with precision by rotation about its rotational axis 50 compared to alternative tool assemblies involving the adapter 100.

As discussed above, the adapter 100 may provide various tool assemblies by connecting various combinations of input drive components with output drive components. Although FIGS. 6A-6C illustrate a non-limiting example of one of various combinations of tool assemblies 200, the adapter 100 is not limited to configuring this tool assembly 200, but is configured to provide various other tool assemblies. As another example, the adapter 100 is configured to provide at least a tool assembly 200 in which the adapter 100 is connected to (i) a torque wrench 202 that is configured to connect to the first input drive connector 134 and (ii) a tool head 206 that is configured to connect to the first output drive connector 138. As yet another example, the adapter 100 is configured to provide at least a tool assembly 200 in which the adapter 100 is connected to (i) a torque wrench 202 that is configured to connect to the second input drive connector 136 and (ii) a tool head 206 that is configured to connect to the first output drive connector 138. Further, as yet another example, the adapter 100 is configured to provide at least a tool assembly 200 in which the adapter 100 is connected to (i) a torque wrench 202 that is configured to connect to the second input drive connector 136 and (ii) a tool head 206 that is configured to connect to the second output drive connector 144. Moreover, the tool assemblies are not limited to the same style of tools (e.g., torque wrench 202 and tool head 206) that are shown in FIGS. 6A-6C, but can include any suitable tools and/or tool components, which are structured to mate with a selected one of the first input drive connector 134 and the second input drive connector 136 along with a selected one of the first output drive connector 138 and the second output drive connector 144. In general, the different tool assemblies provide different features and advantages. As a non-limiting example, for instance, a tool assembly 200, which includes (i) a torque wrench 202 with a drive part 204 that mates with the second input drive connector 136 and (ii) a tool head 206 with a connector part 208 that mates with the first output drive connector 138, is advantageous in being enabled to apply a larger torque to a larger object, such as a mechanical fastener, with precision by rotation about its rotational axis 50 compared to alternative tool assemblies involving the adapter 100.

As described above, the adapter 100 includes a number of advantageous features and benefits. For instance, in an example embodiment, the adapter 100 is structured to provide connections between standard U.S. sized tool components and European sized tool components. More specifically, in the illustrated embodiments, the adapter 100 enables U.S. sized torque wrenches to be used with European style tool heads. The adapter 100 is thus advantageous in enabling workers to use some of their own tools as components (e.g., U.S. torque wrenches) for tasks without requiring full-sized tools (e.g., European sized torque wrenches) to be imported for these same tasks, whereby the importation of these full-sized tools is costly. In this regard, the adapter 100 is beneficial in adapting various sized components to other sized components. Advantageously, the adapter 100 enables various combinations of tool assemblies to be created with ease by enabling users to simply attach and detach them from the adapter 100. Moreover, the adapter 100 is advantageous in being enabled to extend the selected torque wrench with the selected tool head while transferring torque of an accurate measurement to a desired object, such as a mechanical fastener or any suitable physical device.

That is, the above description is intended to be illustrative, and not restrictive, and provided in the context of a particular application and its requirements. Those skilled in the art can appreciate from the foregoing description that the present invention may be implemented in a variety of forms, and that the various embodiments may be implemented alone or in combination. For example, as an alternative, the adapter 100 may be customized to provide connections between European style torque wrenches and U.S. style tool heads (and/or wrench adapters). Moreover, the adapter 100 is not limited to U.S. and European conventions (e.g., sizes, styles, etc.), but may include any of various sizes of input sockets and any of various size output sockets to provide the desired tool assemblies. Also, the adapter 100 is not limited to providing connectors that include sockets, but may include other types of connectors (e.g., male connectors) or a combination of different types of connectors in place of the sockets. Therefore, while the embodiments of the present invention have been described in connection with particular examples thereof, the general principles defined herein may be applied to other embodiments and applications without departing from the spirit and scope of the described embodiments, and the true scope of the embodiments and/or methods of the present invention are not limited to the embodiments shown and described, since various modifications will become apparent to the skilled practitioner upon a study of the drawings, specification, and following claims. For example, components and functionality may be separated or combined differently than in the manner of the various described embodiments, and may be described using different terminology. These and other variations, modifications, additions, and improvements may fall within the scope of the disclosure as defined in the claims that follow.

What is claimed is:

1. An adapter comprising:

a body that is elongated along a first axis, the body having a middle section between a first end section and a second end section when taken along the first axis, the body including:

a first side surface, a second side surface, a third side surface, a first end surface, and a second end surface, the first side surface being opposite to the second side surface, the third side surface being connected to the first side surface and the second side surface, and the first end surface being opposite to the second end surface;

a first input drive connector that is accessible from a same external side of the body as the first side surface, the first input drive connector being structured to mate with a first drive part of a first torque wrench such that a longitudinal axis of the first torque wrench is parallel to the first axis when the first torque wrench is connected to the adapter;

a first extension portion that protrudes outward from the first side surface at the middle section, the first extension portion being defined at least by a wall portion that is flush with the third side surface, the first extension portion including the first input drive connector at a first center region of the first extension portion;

an attachment mechanism that is located on the first side surface of the first end section;

a first output drive connector that is located at the first end surface, the first output drive connector and the attachment mechanism being communicatively connected and structured to mate with a first connector part of a first tool head such that a longitudinal axis of the first tool head is parallel to the first axis when the first tool head is connected to the adapter; and a second output drive connector that is located of the second end surface, the second output drive connector being structured to mate with a second connector part of a second tool head such that a longitudinal axis of the second tool head is parallel to the first axis when the second tool head is connected to the adapter, wherein, the first tool head includes a wrench head, the first input drive connector is defined to be a first size, the first output drive connector is defined to be a second size, the second output drive connector is defined to be another size, and the second size is different from the another size.

2. The adapter of claim 1, wherein:

the body includes a second input drive connector that is located at the middle section of the body and accessible from the second side surface, the second input drive connector being structured to mate with a second drive part of a second torque wrench such that a longitudinal axis of the second torque wrench is parallel to the first axis when the second torque wrench is connected to the adapter; and the second input drive connector is defined to be a third size.

3. The adapter of claim 2, wherein:

the body includes first inner walls that define a ⅜ inch female square drive opening as the first input drive connector;

the body includes second inner walls that define a 14 mm by 18 mm female rectangular drive opening as the first output drive connector; and the body includes third inner walls that define a ½ inch female square drive opening as the second input drive connector.

4. The adapter of claim 2, further comprising:

a second extension portion that protrudes outward from the second side surface at the middle section of the body, the second extension portion including the second input drive connector at a second center region of the second extension portion, wherein the first extension portion is structured to position a first head of the first torque wrench at a first height that is greater than a height of the first side surface such that clearance is provided between the first head of the first torque wrench and the first side surface when the first torque wrench is connected to the adapter, and the second extension portion is structured to position a second head of the second torque wrench at a second height that is greater than a height of the second side surface such that clearance is provided between the second head of the second torque wrench and the second side surface when the second torque wrench is connected to the adapter.

5. The adapter of claim 1, wherein the body includes inner walls that define a 9 mm by 12 mm female rectangular drive opening as the second output drive connector.

6. The adapter of claim 1, wherein:

the adapter is configured to detachably couple the first torque wrench and the first tool head; and the adapter provides a tool assembly with a configuration that includes the first torque wrench and the first tool head such that a rotational axis of the tool assembly is perpendicular to the first axis.

7. The adapter of claim 1, wherein the body includes a tapered portion such that a cross section of the body at a part of the first end section is larger than a cross section of the body at a part of the second end section.

8. The adapter of claim 1, wherein the body further comprises:

a fourth side surface that is opposite to the third side surface, wherein the first extension portion is defined by another wall portion that is flush with the fourth side surface.

9. An adapter comprising:

a body that is elongated along a first axis, the body having a middle section that is between a first end section and a second end section when taken along the first axis, the body including a first side surface, a second side surface, a third side surface, a first end surface, and a second end surface, the first side surface being opposite to the second side surface, the third side surface being connected to the first side surface and the second side surface, and the first end surface is opposite to the second end surface; and a first extension portion located at the middle section, the first extension portion extending outward from the first side surface of the body along a second axis, the first extension portion being defined by a wall portion that is flush with the third side surface, the first extension portion including a first input drive connector accessible from a same external side of the body as the first side surface and configured to receive a first drive part of a first torque wrench such that a longitudinal axis of the first torque wrench is parallel to the first axis when the first torque wrench is connected to the adapter, the first drive part being a first size, wherein, the first end section includes an attachment mechanism that is located on the first side surface between the first extension portion and the first end surface, the first end section includes a first output drive connector that is located on the first end surface, the first output drive connector and the attachment mechanism are communicatively connected and configured to receive a first connector part of a first tool head such that a longitudinal axis of the first tool head is parallel to the first axis when the first tool head is connected to the adapter, the first connector part being a second size, the first tool head includes a wrench head, the first size is different from the second size, and the first axis is perpendicular to the second axis.

10. The adapter of claim 9, wherein:

the body includes a second input drive connector that is located at the middle section of the body and accessible from the second side surface of the body, the second input drive connector being structured to mate with a second drive part of a second torque wrench such that a longitudinal axis of the second torque wrench is parallel to the first axis when the second torque wrench is connected to the adapter; and the second input drive connector is defined to be a third size.

11. The adapter of claim 10, wherein:

the body includes first inner walls that define a ⅜ inch female square drive opening as the first input drive connector;

the body includes second inner walls that define a 14 mm by 16 mm female rectangular drive opening as the first output drive connector; and the body includes third inner walls that define a ½ inch female square drive opening as the second input drive connector.

12. The adapter of claim 9, further comprising:

a second extension portion that protrudes outward from the second side surface at the middle section of the body, the second extension portion including a second input drive connector at the second extension portion, wherein the first extension portion is structured to position a first head of the first torque wrench at a first height that is greater than a height of the first side surface such that clearance is provided between the first head of the first torque wrench and the first side surface when the first torque wrench is connected to the adapter, and the second extension portion is structured to position a second head of a second torque wrench at a second height that is greater than a height of the second side surface such that clearance is provided between the second head of the second torque wrench and the second side surface when the second torque wrench is connected to the adapter.

13. The adapter of claim 9, wherein:

the adapter is configured to detachably couple the first torque wrench and the first tool head; and the adapter provides a tool assembly with a configuration that includes the first torque wrench and the first tool head such that a rotational axis of the tool assembly is perpendicular to the first axis.

14. The adapter of claim 9, wherein:

the body includes a second output drive connector that is located at the second end surface, the second output drive connector being structured to mate with a second part of a second tool head such that a longitudinal axis of the second tool head is parallel to the first axis when the second tool head is connected to the adapter;

the second output drive connector is defined to be another size; and the second size is different from the another size.

15. The adapter of claim 14, wherein the body includes inner walls that define a 9 mm by 12 mm female rectangular drive opening as the second output drive connector.

16. A tool assembly comprising:

a torque wrench having a drive part of a first size;

a tool head having a connector part of a second size; and an adapter configured to detachably couple the torque wrench and the tool head, the adapter including:

a body that is elongated along a first axis, the body having a middle section between a first end section and a second end section when taken along the first axis, the body including:

a first side surface, a second side surface, a third side surface, a first end surface, and a second end surface, the first side surface being opposite to the second side surface, the third side surface being connected to the first side surface and the second side surface, and the first end surface being opposite to the second end surface;

a first input drive connector that is accessible from a same external side of the body as the first side surface, the first input drive connector being structured to mate with the drive part of the torque wrench such that a longitudinal axis of the torque wrench is parallel to the first axis when the torque wrench is connected to the adapter;

a first extension portion that protrudes outward from the first side surface at the middle section, the first extension portion being defined at least by a wall portion that is flush with the third side surface, the first extension portion including the first input drive connector at a first center region of the first extension portion;

an attachment mechanism that is located on the first side surface of the first end section;

a first output drive connector that is located at the first end surface, the first output drive connector and the attachment mechanism being communicatively connected and structured to mate with the connector part of the tool head such that a longitudinal axis of the tool head is parallel to the first axis when the tool head is connected to the adapter; and a second output drive connector that is located at a middle region of the second end surface, the second output drive connector being structured to mate with another connector part of another tool head such that a longitudinal axis of the another tool head is parallel to the first axis when the another tool head is connected to the adapter, wherein, the tool head includes a wrench head, the first size is different than the second size, the another connector part is another size, and the another size is different than the second size.

17. The tool assembly of claim 16, wherein:

the body includes a second input drive connector that is located at the middle section of the body and accessible from the second side surface, the second input drive connector being structured to mate with another drive part of another torque wrench such that a longitudinal axis of the another torque wrench is parallel to the first axis when the another torque wrench is connected to the adapter; and the second input drive connector is defined to be a third size.

18. The tool assembly of claim 17, wherein:

the body includes first inner walls that define a ⅜ inch female square drive opening as the first input drive connector;

the body includes second inner walls that define a ½ inch female square drive opening as the second input drive connector;

the body includes third inner walls that define a 14 mm by 18 mm female rectangular drive opening as the first output drive connector; and the body includes fourth inner walls that define a 9 mm by 12 mm female rectangular drive opening as the second output drive connector.

19. The tool assembly of claim 16, further comprising:

a second extension portion that protrudes outward from the second side surface at the middle section of the body, the second extension portion including a second input drive connector at a second center region of the second extension portion, wherein the first extension portion is structured to position a head of the torque wrench at a height that is greater than a height of the first side surface such that clearance is provided between the head of the torque wrench and the first side surface when the torque wrench is connected to the adapter, and the second extension portion is structured to position another head of another torque wrench at another height that is greater than a height of the second side surface such that clearance is provided between the another head of the another torque wrench and the second side surface when the another torque wrench is connected to the adapter.

20. The tool assembly of claim 16, wherein the adapter provides the tool assembly with a configuration such that a rotational axis of the tool assembly is perpendicular to the first axis when the torque wrench and the tool head are connected to the adapter.

* * * * *